US007464631B2

(12) United States Patent
Nottingham et al.

(10) Patent No.: US 7,464,631 B2
(45) Date of Patent: Dec. 16, 2008

(54) SHAPE FORMING DEVICE

(75) Inventors: John Nottingham, Bratenahl, OH (US); John Spirk, Gates Mills, OH (US); Patrick Brown, Mantua, OH (US); Robert Dorsey, Columbia Station, OH (US); Trevor Jackson, Kirtland, OH (US); Carolyn McNeeley, Brunswick Hills, OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 394 days.

(21) Appl. No.: 11/276,928

(22) Filed: Mar. 17, 2006

(65) Prior Publication Data

US 2006/0283302 A1 Dec. 21, 2006

Related U.S. Application Data

(60) Provisional application No. 60/687,594, filed on Jun. 3, 2005.

(51) Int. Cl.
*B26D 7/27* (2006.01)
*B26D 5/14* (2006.01)

(52) U.S. Cl. ..... 83/522.12; 83/566; 83/860; 100/176; 72/211; 72/449; 271/15; 425/298; 425/363; 425/411

(58) Field of Classification Search ..... 72/211, 72/449; 100/176; 271/15; 83/569, 860; 425/298, 363, 411
See application file for complete search history.

(56) References Cited

U.S. PATENT DOCUMENTS 3,335,592 A * 8/1967 Woodling ..... 72/466.9
3,766,816 A 10/1973 Loveless
3,843,763 A 10/1974 Coll-Palagos
3,868,878 A 3/1975 Peak
3,924,328 A 12/1975 Mould
4,057,242 A 11/1977 Rau
4,116,594 A 9/1978 Leanna et al.
4,132,155 A 1/1979 Hicks et al.
4,860,622 A * 8/1989 Di Bernardo ..... 83/567
5,101,564 A 4/1992 Melter
5,109,743 A 5/1992 Gammerler
5,302,167 A 4/1994 Kley et al.
5,431,077 A 7/1995 Murakami
5,647,260 A 7/1997 Nabity
5,727,417 A * 3/1998 Moffatt et al. ..... 72/453.16
5,765,289 A 6/1998 Schulz et al.
5,778,748 A 7/1998 Beijen
D399,110 S 10/1998 Schultz et al.

(Continued)

OTHER PUBLICATIONS

Sizzix SideKick, http://.provocraft.com/products/index.sizzix.php?cl=sizzix, Jun. 21, 2005.

*Primary Examiner*—David B Jones
(74) *Attorney, Agent, or Firm*—Calfee, Halter & Griswold LLP

(57) ABSTRACT

Disclosed is a shape forming device for use with dies to provide cut, punched and embossed objects made from a variety of media. The shape forming device includes a housing that contains at least one pair of rollers oriented substantially parallel to one another, a power supply, electrically connected to the pair of rollers to drive their rotation so as to permit the feeding of a die between the rollers.

12 Claims, 5 Drawing Sheets

U.S. PATENT DOCUMENTS

| | | | | |
|---|---|---|---|---|
| 5,913,765 | A | 6/1999 | Burgess et al. | |
| 6,131,636 | A * | 10/2000 | Anderson et al. | 100/176 |
| 6,176,819 | B1 | 1/2001 | Boegli | |
| 6,220,136 | B1 * | 4/2001 | Benes et al. | 83/566 |
| 6,643,936 | B2 | 11/2003 | Carlson et al. | |
| 6,871,585 | B2 * | 3/2005 | Sato et al. | 100/176 |
| 6,981,398 | B2 * | 1/2006 | Toben et al. | 72/211 |
| 7,293,501 | B2 * | 11/2007 | Lee | 100/176 |
| 7,335,009 | B2 * | 2/2008 | Lee | 425/298 |
| 2003/0209122 | A1 | 11/2003 | Nguyen | |
| 2005/0253324 | A1 * | 11/2005 | Corcoran et al. | 271/15 |

* cited by examiner

SHAPE FORMING DEVICE

PRIORITY CLAIM

This application claims priority to U.S. Provisional Patent Application 60/687,594, filed Jun. 3, 2005, which is incorporated herein by reference, in its entirety.

TECHNICAL FIELD

The present invention is directed to a power shape forming device for use with dies to facilitate the cutting and embossing of paper and other media.

BACKGROUND OF INVENTION

A variety of tools and devices are known in the art for use with dies to form cut outs from and emboss paper and other materials. Certain of these devices require the user to manipulate one or several parts to properly position and hold a die in place, and to apply sufficient pressure to the die/media combination to achieve cutting or embossing. Some of these devices are light duty, and prone to breakage after multiple uses. The more robust devices are suited to industrial level use and are thus heavy and cumbersome to handle, and can be prohibitively expensive for consumer use. Accordingly, there is a need for a shape forming device for use with dies that is easy to use, sufficiently sturdy to withstand multiple cycles of use, and can be manufactured at a price point that makes it accessible to the consumer.

SUMMARY OF THE INVENTION

It is an object of this invention to provide a versatile and easy-to-use shape forming device for use with dies adapted for cutting and embossing a variety of media, such as paper, fabric, foil, leaves and other thin materials, using one of a variety of cutting or embossing dies known in the art. Various embodiments of the present invention are directed to electrically powered shape forming device that may be used in crafts, such as scrapbooking, to cut out shapes from or emboss paper or other materials. One embodiment of the shape forming device includes a housing that supports a pair of rollers configured to exert a compressive force. In use of the illustrated embodiment, one or more cutting or embossing dies are arranged in a stacked configuration with one or more pieces of media from which shapes are to be formed. The die stack is fed between the rollers of the shape forming device, whereby a shape is formed with the media by application of compressive force on the die stack.

An advantage of the shape forming device is the ease in which it can be used for embossing and die-cutting paper. Due to the ease with which the shape forming device can be used, it can be operated by a wide range of users, from the very young to the elderly or even those who have health problems that limit the use of their hands, such as arthritis. Another advantage of the shape forming device of the illustrated embodiment is that due to its compact size, the shape forming device is easily stored and transported.

DETAILED DESCRIPTION OF THE INVENTION

Figure 1:
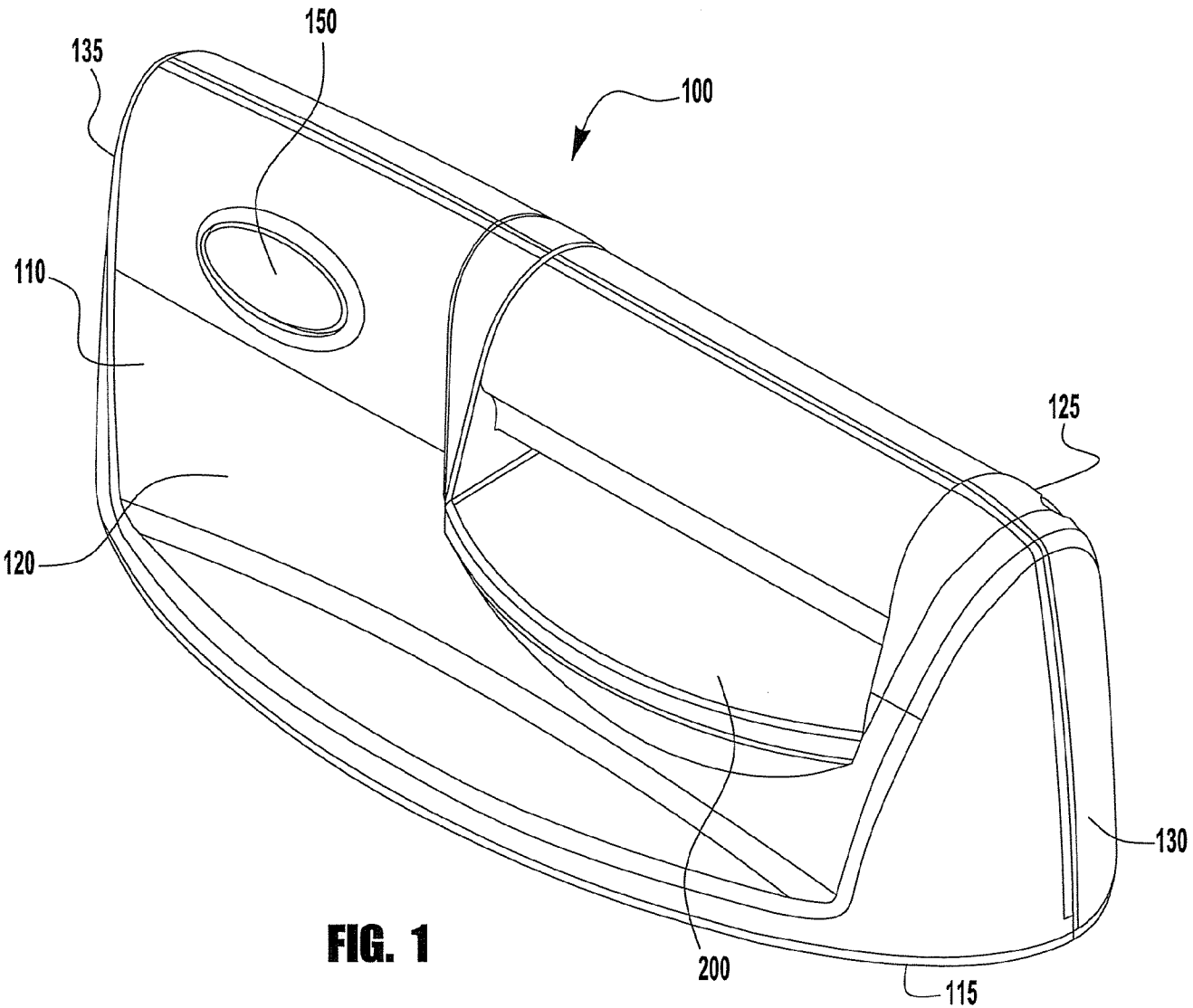
FIG. 1 shows a front perspective view of one embodiment of the shape forming device according to the present invention.

The present invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the invention. As used in the description of the invention and the appended claims, the singular forms "a," "an," and "the" are intended to include the plural forms as well, unless the context clearly indicates otherwise. Also as used in the description of the invention and the appended claims, the terms "upper", "lower", "right", "left", "vertical", "horizontal", "top", "bottom", and derivatives thereof shall relate to the invention as it is oriented in the drawing figures.

Unless otherwise indicated, all numbers expressing quantities, properties, and so forth as used in the specification and claims are to be understood as being modified in all instances by the term "about." Accordingly, unless otherwise indicated, the numerical properties set forth in the following specification and claims are approximations that may vary depending on the desired properties sought to be obtained in embodiments of the present invention. Notwithstanding that the numerical ranges and parameters setting forth the broad scope of the invention are approximations, the numerical values to the extent that such are set forth in the specific examples are reported as precisely as possible. Any numerical values, however, inherently contain certain errors necessarily resulting from error found in their respective measurements.

Except as otherwise indicated, the disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

The invention is directed, in various embodiments, to power shape forming devices for use with dies adapted for cutting and embossing a variety of media, such as paper, fabric, foil, leaves and other thin materials, using one of a variety of cutting or embossing dies known in the art. The devices include a pair of rollers which are configured to exert a compressive force. In use, one or more cutting or embossing dies are arranged in a stacked configuration with one or more pieces of media from which shapes are to be formed, and together with optional top and bottom plates, the die stack is fed between the rollers of the shape forming device, whereby a shape is formed with the media by application of compressive force on the die stack.

Figure 2:
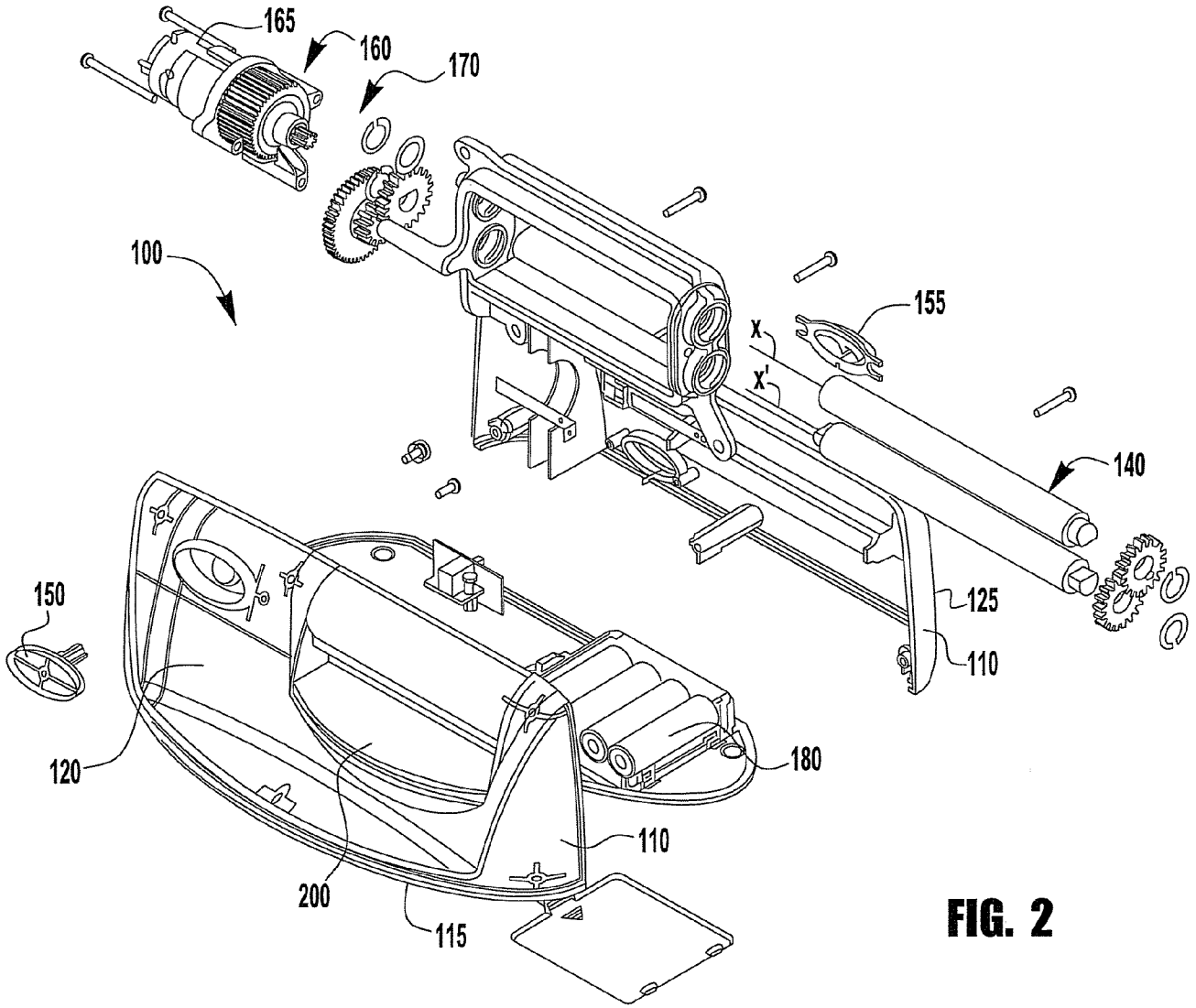
FIG. 2 shows an exploded perspective view of the shape forming device shown in FIG. 1.

As representative of one embodiment according to the invention, FIG. 1 illustrates a power shape forming device 100. The shape forming device 100 of the illustrated embodiment generally includes a housing 110, at least one pair of rollers 140 (as shown in FIG. 2) mounted within the housing 110, each of which rollers is rotatable around its respective central axis X and X' (shown in FIG. 2), and a drive mechanism 160 for powering rotation of the rollers 140. The housing 110 and the rollers 140 are adapted to permit an assembled die and media stack to be inserted between the rollers 140 of the shape forming device 100.

The housing 110 is molded from plastic, but other suitable materials could also be used. In the illustrated embodiment, the housing 110 has the general shape of a triangular prism. The upper, thinner portion of the triangular prism shaped housing of the illustrated embodiment is adapted to be easily grasped and held by the hand of the user both when the user is operating the shape forming device or picking it up and moving it. To further aid the user in grasping the shape forming device, one or more indentations could be defined within the housing to give the user a gripping surface as well as a place to rest their fingers or other portion of their hand. It should be apparent, however, that such indentations are not necessary and must not be present with every embodiment of the shape forming device. It should also be apparent to one skilled in the art, that the housing 100 could be shaped differently, for example the housing could have a generally rectangular or cylindrical shape or it could be domed or hemispherical. Finally, it should also be apparent that the housing 110 could also be produced in various sizes.

The configuration of the housing 110 is adapted to support and enclose other components of the shape forming device 100. Referring now to FIG. 2, which shows an exploded perspective view of the shape forming device 100 shown in FIG. 1, the housing 110 has a generally flat support base 115, a front wall 120, a back wall 125, and a pair of opposable side walls 130, 135 that extend from the bottom wall to form a partially closed space that encloses other components of the shape forming device 100. Each of the front and back walls 120, 125 are adapted with openings that correspond with the interface between the rollers 140 to permit the insertion of die stacks therein. It should be apparent to one skilled in the art that the housing 110 could consist of multiple parts assembled together or could have a one piece, unitary construction. In the illustrated embodiment, the housing 110 is formed of multiple parts that correspond to the support base 115, the front wall 120 and the back wall 125, which are connected and secured to one another using inter-engaging tabs and slots, and screws inserted through screw holes. While the tabs slots, and screw holes are shown in the embodiment of FIG. 2, several other methods of assembling the housing 110 could be used, including but not limited to glue, different configurations of tabs, slots, screws, sonic welding other engagement means, and combinations thereof.

The shape forming device 100 of the illustrated embodiment includes at least one pair of rollers 140 that are mounted, for example, by snap fit, in the housing 110 such that each roller is rotatable around one of a pair of parallel axes X and X', with one roller positioned above the other roller. According to some of the various embodiments of the invention, the motion of the two rollers 140, in use, is such that, when the front wall 120 of the device is viewed in perspective along the length of the shape forming device 100 from the right end wall 135, the uppermost roller rotates in a counterclockwise motion, while the lower roller rotates in a clockwise motion. Accordingly, the motion of the pair of rollers 140 is configured to draw a die stack inserted therebetween to effect movement of the die stack from its insertion position at the front wall 120 to its ejection from the back wall 125 of the shape forming device 100.

According to shape forming devices 100 of various embodiments of the present invention, the rollers 140 of the shape forming device 100 are adapted to accept the insertion of a die stack having a thickness of between generally 0.1 inches and generally 2.0 inches. Accordingly, the rollers 140 of the shape forming device 100 are adapted to accept the insertion of a die stack having a thickness of generally 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95 or 2.00 inches.

According to various embodiments of the shape forming device 100, the pair of rollers 140 is driven to rotation by a drive mechanism 160. As illustrated in representative FIG. 2, the drive mechanism 160 is housed within the housing 110, and as such, is integrated within the device. Of course, one of ordinary skill will appreciate that the drive mechanism 160 could be contained as a module within a separate housing (not shown), and engaged with the rollers 140 of the shape forming device 100 to drive rotation of the rollers 140. Such a modular drive mechanism could be engaged with various modules that each perform a different function and possess different features, such as a paper or media cutter, a paper or media crimper, a paper or media embosser, etc.

According to some embodiments, the shape forming device 100 of the illustrated embodiment includes a drive mechanism that includes an electric motor 165. In alternate embodiments, the shape forming device 100 could also manually powered, such as by a hand-crank or other device. The shape forming device 100 could also include both an electric motor and an apparatus that manually drives the device, such as a hand crank. In this manner, the shape forming device could be both electronically and manually powered. Accordingly, the device could then be manually driven if a power supply is not available or if the shape forming device becomes jammed and the user wished to manually drive the rollers 140 to rotate in order to remove the material jamming the device.

Referring again to FIG. 2, the electric motor 165 in accordance with the depicted embodiment is supported and enclosed within the housing 110. The electric motor 165 has a generally cylindrically shape and a protruding output shaft (not shown) that rotates when the motor 165 is activated. Multiple types and configurations of electrical motors may be used with the shape forming device 100. Accordingly, various combinations of motor components, including motor cage sizes, wire sizes, number of wire winds, and magnet types may be used according to the present invention. The electric motor 165 rotates its output shaft at between 10,000 revolutions per minute to 25,000 revolutions per minute when no load is placed on the electric motor 165. According to the present invention, the electric motor rotates its output shaft at 10000, 10250, 10500, 10750, 11000, 11250, 11500, 11750, 12000, 12250, 12500, 12750, 13000, 13250, 13500, 13750, 14000, 14250, 14500, 14750, 15000, 15250, 15500, 15750, 16000, 16250, 16500, 16750, 17000, 17250, 17500, 17750, 18000, 18250, 18500, 18750, 19000, 19250, 19500, 19750, 20000, 20250, 20500, 20750, 21000, 21250, 21500, 30250, 22000, 22250, 22500, 22750, 23000, 23250, 23500, 23750, 24000, 24250, 24500, 24750, or 25000 revolutions per minute when no load is placed on the electric motor 165. The torque of the output shaft of the electric motor 165 is from 4 to 25 MilliNewton Meters. According to the present invention, the electric motor torque is 4, 5, 6, 7, 8, 9, 10, 11, 12, 13, 14, 15, 16, 17, 18, 19, 20, 21, 22, 23, 24, 25 MilliNewton Meters, or fractions thereof.

The drive mechanism 160 of the shape forming device 100 also includes a gear assembly 170, also supported and enclosed within the housing 11O. In the illustrated embodiment, the gear assembly 170 is fashioned out of plastic, but other suitable materials, such as metal, or combinations of metal and plastic could be used. The gear assembly 170 mechanically connects the electric motor 165 with the gears, which in turn are connected to and drive rotation of the pair of rollers 140. When the electric motor 165 is activated, the gear assembly 170 drives the rollers 140. The gear assembly 165 of the illustrated embodiment includes a series of optional step-down gears, which are adapted to increase the torque output of the electric motor. It should be apparent to one skilled in the art that several configurations of gear assemblies could be utilized. Additionally, the electric motor 165 could be directly engageable with the rollers 140.

In some embodiments, a gear assembly 170 comprises reduction gears. As used herein in the context of gears, the term "reduction" means gearing that reduces an input speed to a slower output speed. In some embodiments, reduction gears having a planetary arrangement are used to drive rotation of the rollers 140. As used herein, the term "planetary gearset" refers to a gearset in which all of the gears are in one plane, grouped around each other like the planets around the sun. The central gear is called the "sun gear." In mesh with it is a circular grouping of gears, called "planet gears," mounted on a rotating carrier. The planet gears also engage teeth on the inner periphery of the "ring gear." By holding any one of the three gear elements motionless, different ratios can be produced between the other two. In other embodiments, reduction gears having a compound arrangement are used to drive rotation of the rollers 140. As used herein, the term "compound gearset" means a gearset in which two or more gears are fixed on the same shaft.

Figure 6:
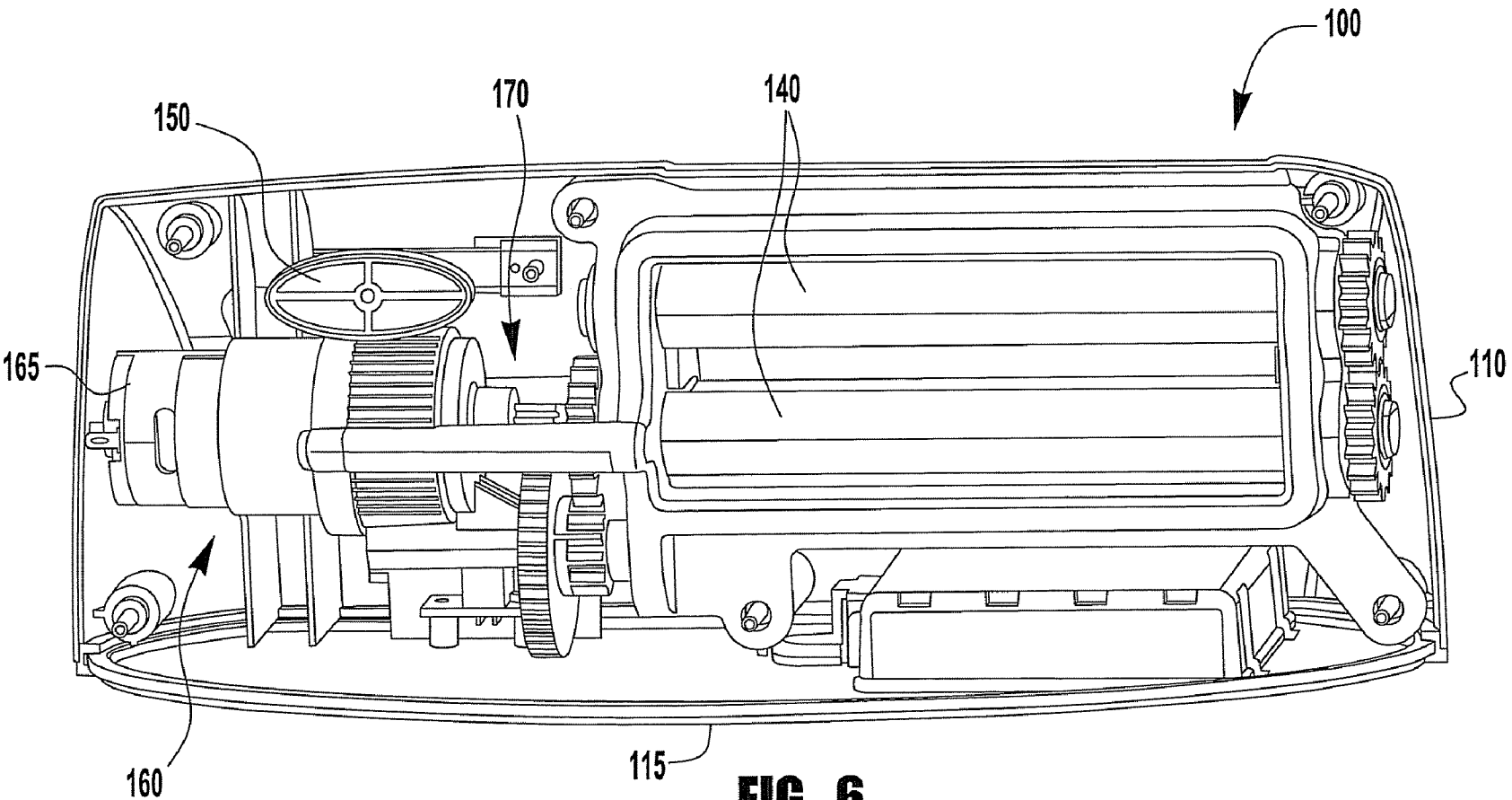
FIG. 6 is a cut-away front view of the shape forming device shown in FIG. 1 with a front portion of the housing removed.

When the electric motor 165 is activated and the output shaft of the electric motor 165 rotates, a cylindrical gear mounted on the output shaft rotates and drives the main gear of the gear assembly 170. The main gear is mechanically connected with the gear assembly receiver portion of the pair of rollers 140. The main gear, together with the gear assembly receiver portion of the rollers 140, transfer the rotational motion of the cylindrical gear mounted on the output shaft of the electric motor 165 to the pair of rollers 140. Accordingly, as the cylindrical gear turns, the main gear of the gear assembly 170 turns; as the main gear turns, each of the optional one or more additional step gears are driven to rotate, and in turn, the pair of rollers 140 are driven to rotate. In various embodiments of the present invention, each of the rollers 140 could be driven to rotation by direct engagement with the gear assembly 170. In the illustrated embodiment, however, one of the rollers is driven to rotation by the gearing assembly 170 and the driven roller in turn drives the other roller to rotation (as shown in FIG. 6). The number, sizes, and ratios of the gears in the gear assembly 170 influence whether the rate of rotation of rollers 140 is the same as or different from the rate of rotation of the output shaft of the electric motor 165. Good results have been obtained using step gears according to the embodiment illustrated in FIG. 2, where the step gear engages with a gear receive portion on the rollers 140, and where the gear ratios are 1079:1. It should be apparent to one skilled in the art that additional embodiments of the paper detailer could include a variety of gear ratios. In some embodiments, the gear assembly comprises one or more washers, one or more supports, and one or more bushings (not shown), which serve to support and aid in smooth rotation of the rollers 140 within the gear assembly 170. Of course, other combinations of gears and other gear ratios can be used with a variety of gear assemblies together with a variety of different motors having selected motor specifications, polish head dimensions, and power source output, wherein the combination of such factors provides torque and rotational speeds for each head in the ranges recited herein.

The shape forming device 100 of the illustrated embodiment includes 1.5 volt AA alkaline batteries 180 that are supported and enclosed within the housing 110 on the support base. The batteries are electronically connected with the electric motor 165 and the activation switches 150, and 155 of the shape forming device 100 by wires (not shown) and they power the electric motor 165. Different types and numbers of batteries could be effectively used. Additional power to the shape forming device 100 can be achieved by increasing either or both the number and the voltage of the batteries. By varying the number and/or the voltage of the batteries, the rotational speed and the torque of the electric motor 165 is influenced, and in turn, the rotational speed and the torque of rollers 140 is influenced. When determining the number and voltage output of batteries to be included in the shape forming device 100, the effectiveness of the shape forming device 100, the manufacturing cost, and the size of the housing 110 are considered. Of course, alternate means of providing power to the device may be used. For example the shape forming device 100 may be powered externally using alternating or direct current. Accordingly, in alternate embodiments, the shape forming device 100 comprises an alternating current adapter for use with standard U.S. household current, and a power cord having a plug for insertion into standard household electric receptacle. In yet other alternate embodiments, the shape forming device 100 comprises a direct current adapter for converting various voltages of direct current to a fixed voltage, and a power cord having a plug for insertion into a direct current electric receptacle.

Figure 3:
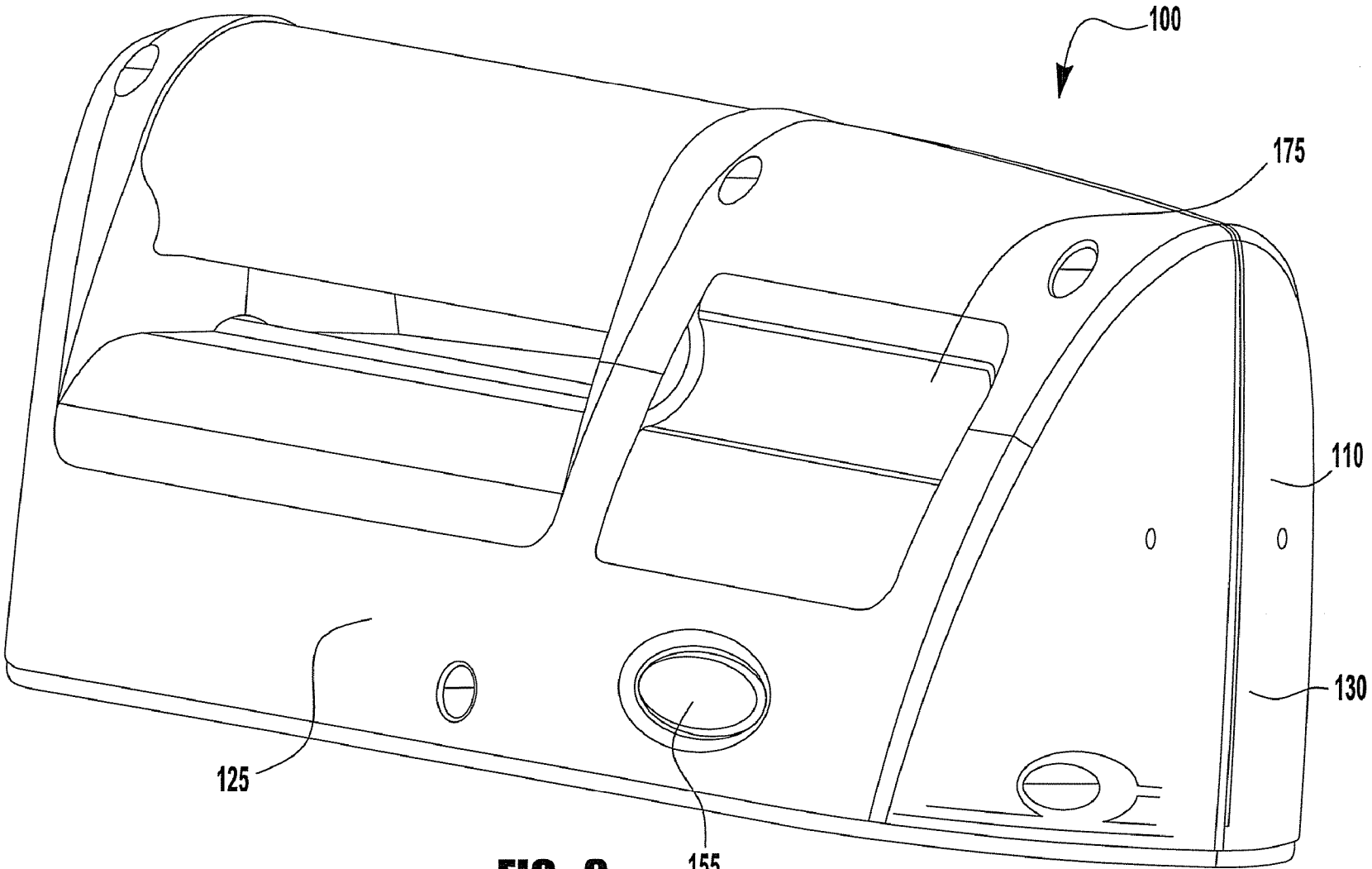
FIG. 3 is a back perspective view of the shape forming device shown in FIG. 1.
Figure 5:
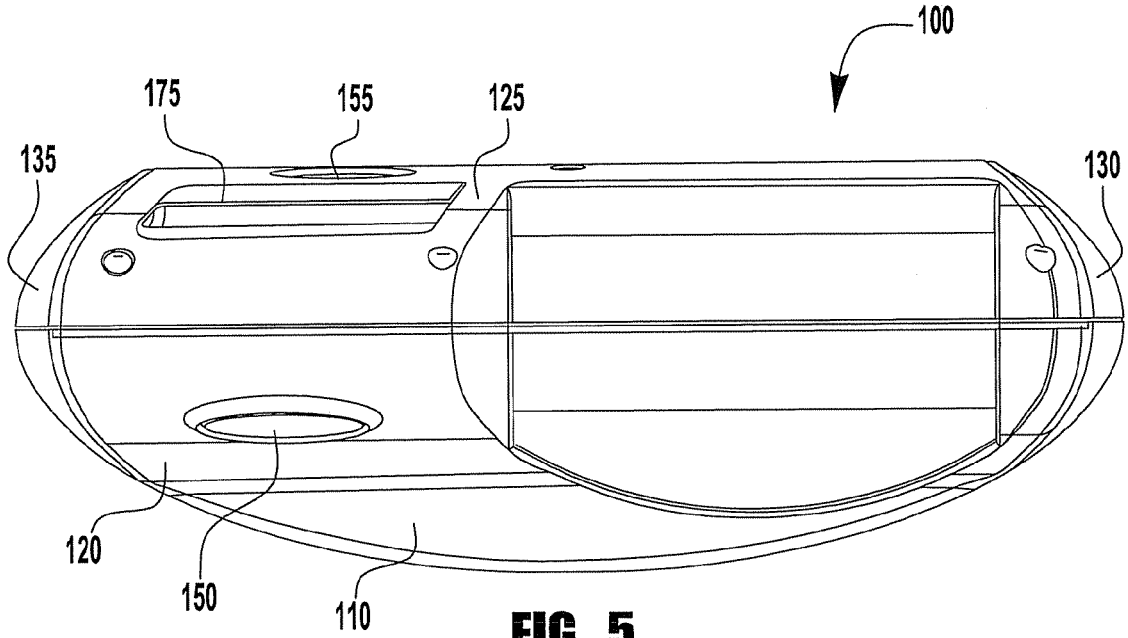
FIG. 5 is a top view of the shape forming device shown in FIG. 1.

Referring now to FIG. 1, FIG. 3 and FIG. 5, in various embodiments, the shape forming device 100 of the illustrated embodiment includes a forward activation switch 150 and a reverse activation switch 155 (connected to the electrical motor 165 by wires not shown). In the illustrated embodiment, each activation switch 150, 155 is a momentary switch, but one of a variety of different types of switches could be used. Upon activation by depressing one of the momentary switches, the electric motor 165 runs until the depressed momentary switch is released. However, alternative embodiments may include switches that do not have to be continuously pressed to activate the electric motor 165. It should be apparent to those skilled in the art that the present invention could include many different types of switches rather than momentary switches, and other embodiments may not include an interior switch or deformable membrane. For example, the shape forming device 100 could include an automatic start mechanism which would activate the electric motor 165 when an object comes within a predetermined distance of the rollers 140. The forward activation switch 150 of the illustrated embodiment activates the electric motor 165 in a forward direction thereby drawing the die stack from its insertion position at the front wall 120 to its ejection from the back wall 125 of the shape forming device 100. The reverse activation switch 155 of the illustrated embodiment activates the electric motor 165 in a reverse direction thereby reversing the direction of rotation of the rollers 140 and urging the die stack from the back wall 125 of the device towards the insertion position at the front wall 120. It should be apparent to those skilled in the art, however, that the provision of two activation switches corresponding to two activation states of the electric motor 165 is not necessary and need not be provided with all embodiments of the present invention.

In some embodiments of the present invention the operation of the shape forming device in either the forward or the reverse activation state may require the activation of an additional power supply. Accordingly, the forward activation switch 150 or reverse activation switch 155 could be electronically configured to simultaneously activate an additional power source, such as additional 1.5 volt AA batteries, when it is depressed to activate the electric motor 165. It should be apparent to those skilled in the art, however, that this additional power supply is not critical and need not be provided with all embodiments of the present invention.

In the illustrated embodiment, the forward activation switch 150 is mounted within the front wall 120 of the housing 110 and the reverse activation switch 155 is mounted within the back wall 125 of the housing 1 10. The location and orientation of the forward and reverse activation switches 150, 155 of the illustrated embodiment are adapted to allow a user to easily grasp the shape forming device 100 and manipulate both the forward and reverse activation switches with the same hand. The shape forming device 100 also includes a finger grip 175 that is adapted to be gripped by one or more of the fingers of a users hand while the forward activation switch 150 is depressed by the user's thumb. According to the illustrated embodiment, the finger grip 175 is positioned above the reverse activation switch 155 on the back wall 125 of the housing 110. The finger grip 175, and its position, are well suited to enable the user to securely grip the shape forming device 100 during use, and avoid inadvertently activating the reverse activation switch 155 at the same time as the forward activation switch 150, and thus minimize the risk of jamming the device. However, it should be apparent to one skilled in the art that the switches 150, 155, and the finger grip 175 could be mounted to the housing 110 or other portion of the shape forming device 100 in different places. In addition, it should be apparent that the forward and reverse activation switches 150, 155 are optional and need not be included with all embodiments of the shape forming device 100, particularly embodiments in which the drive mechanism does not include an electric motor. Moreover, switches for driving the rollers 140 could be located on a separate module that houses the drive mechanism 160 separate from the housing 110.

Figure 4:
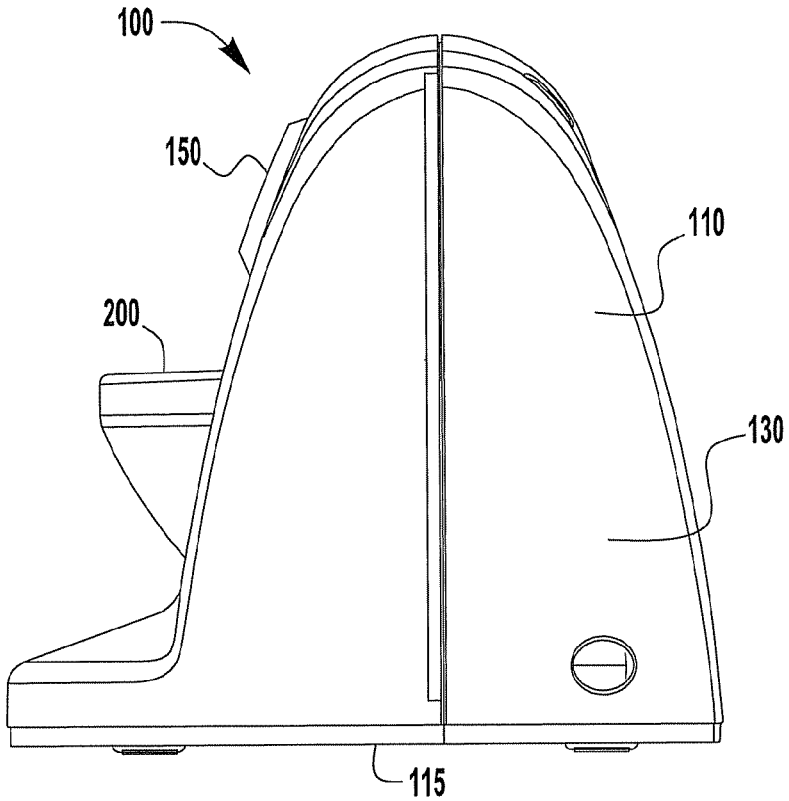
FIG. 4 is side view of the shape forming device shown in FIG. 1.

In the illustrated embodiment, the housing includes an optional support platform 200, as viewed in FIG. 4. The support platform 200 is a generally planar structure that projects from the housing 110 on both the front and back walls 120, 125. According to the illustrated embodiment, the support platform 200 is integrally molded with the housing 110. In alternate embodiments (not shown), the support platform 200 is formed separately from the housing 110, and is attached thereto on one or both of the front and back walls 120, 125. According to such embodiments, when the shape forming device 100 is in use, the support platform 200 is selectively flipped up and locked in a position that is generally perpendicular to the housing 110, much like the embodiment depicted in FIG. 1 and FIG. 4 in which the support platform 200 is integral with the housing 110. The support platform 200 supports the weight of the die and media stack that is to be fed into the shape forming device 100, and assists the user in controlling the rate and positioning of the stack when feeding the same into the shape forming device 100. By supporting the weight of the die and media stack, the support platform 200 helps to ensure that the compressive force exerted on the die stack will be uniformly applied, and the resultant formed shape(s) will be clearly and evenly rendered onto the media. It should be apparent to those skilled in the art that in additional embodiments, the support platform 200 could be selectively removable from the housing 110.

In some embodiments, the support platform 200 includes a guide (not shown) that aides in the positioning of the die stack for insertion between the rollers 140. According to certain such embodiments, the guide is attached to the support platform 200 and is selectively moveable relative thereto to accommodate various shapes and sizes of die stacks. The guide may be aligned with the edge of the die stack being inserted into the shape forming device 100 by the user to ensure that the combination does not become crooked when entering the shape forming device 100. It should be apparent to one skilled in the art, that the support platform 200 and guide are not limited to the shape and configuration shown in the illustrated embodiment but could be shaped and configured differently. For example, the support platform 200 could have greater or lesser size dimensions, or could simply be an opening defined within the housing 110. In addition, it should be apparent that the support platform 200 and guide are optional and need not be included with all embodiments of the shape forming device 100.

In use, the shape forming device 100 is adapted to receive and apply compressive force to a stack formed by a combination including at least one die and at least one piece of media. When the forward activation switch 150 is activated, which activates the electric motor 165 and causes the upper roller to rotate in a counter-clockwise manner and the lower roller to rotate in a clockwise manner, i.e. when viewed from the right side in FIG. 1. The user then positions the die stack on the support platform 200, and feeds the stack between the rollers 140, the rotating action of the rollers 140 thereby pulling the die stack into the shape forming device 100. The powered rollers 140 roll the die stack through the shape forming device 100, and the force of the rollers 140 compresses the stack, thereby causing the blade on the die to either emboss, or pierce the media so as to form either an embossed texture on the media, or to form a cut shape, or combinations thereof When a user wishes to eject a die stack from the shape forming device 100, or otherwise reverse the rolling process to facilitate further cutting or embossing, the reverse activation switch 155 is pressed, which activates the electric motor 165 and causes the upper roller to rotate in a clockwise manner and the lower roller to rotate in a counter-clockwise manner, i.e. when viewed from the right side in FIG. 1, thereby ejecting the die stack from the shape forming device 100, or otherwise reversing its direction of movement therethrough. In the illustrated embodiment, the reverse activation switch 155 only activates the electric motor 165 when the forward activation switch 150 is simultaneously pressed; however, it should be apparent that the switches could activate the electric motor independently of each other in additional embodiments. In the illustrated embodiment, to provide extra power during the reverse operation of the shape forming device, the reverse activation switch 155 is electrically connected with additional batteries that are activated during the reverse operation of the device. The additional power provided by the extra batteries proves helpful if a die stack or other material becomes jammed between the rollers and needs to be ejected. These additional batteries need not be provided with all embodiments of the shape forming device, however. It should be apparent to one skilled in the art that the direction of the rotation of the rollers 140 could be different in additional embodiments and that it is also not necessary for both of the rollers to be driven by the electric motor.

Thus, the illustrated embodiment of the present invention is a portable, easy-to-use, battery-operated shape forming device 100 used in crafts and scrapbooking, but suitable for other similar uses. Since the shape forming device 100 is in some embodiments electrically powered, the user can effortlessly emboss or cut patterns or shapes into a variety of media. Thus, the paper shape forming device 100 assists the user in the general crafting process.

The embodiments described above are examples of preferred embodiments and are not intended to limit the scope of the claims set forth below. Variations to the inventions described herein, including alternate embodiments not specifically described, are quiet possible and are encompassed by the claims as understood by one of ordinary skill in the art. Indeed, the claimed inventions have their broad and ordinary meaning as set forth below in the claims.

The invention claimed is:

1. A shape former, comprising:

a housing; and a pair of rollers rotatably supported substantially within the housing and operatively connected with the electric motor; wherein the pair of rollers are substantially parallel to each other and are adapted to receive between them a die stack; and wherein the rollers are adapted to exert a compressive force on the die stack as the die stack travels between the rollers, whereby the compressive force of the rollers is sufficient to cause the die stack to render a predetermined shape or pattern on or with at least one piece of media placed within the die stack; and wherein the pair of rollers are adapted for engagement with a drive mechanism, wherein the drive mechanism is an electric motor that has a forward activation state and a reverse activation state;

a power source for supplying power to the electric motor, the power source being selected from at least one battery and an alternative current adapter for use with standard U.S. household current; and a first and second activation switch operatively connected to the electric motor for activating the electric motor; wherein the activation switches are located on an outside surface of the housing; and wherein the first activation switch activates the electric motor in the forward activation state and the second activation switch activates the electric motor in the reverse activation state, wherein the second activation switch which activates the electric motor in the reverse activation state also activates an additional power source for the electrical motor to provide additional power for use with the reverse activation state.

2. The shape former of claim 1 wherein at least one of the pair of rollers is padded.

3. The shape former of claim 1 wherein the pair of rollers are adapted to receive a die stack of generally between 0.1 inches thick and 2.0 inches thick.

4. The shape former of claim 3 wherein the pair of rollers are adapted to receive a die stack of generally between 0.15 inches thick and 0.5 inches thick.

5. The shape former of claim 4 wherein the pair of rollers are adapted to receive a die stack of generally 0.25 inches thick.

6. The shape former of claim 1 wherein the electric motor produces an output of generally between 12,000 and 20,000 revolutions per minute.

7. The shape former of claim 6 wherein the electric motor produces an output of generally between 14,000 and 17,000 revolutions per minute.

8. The media detailer of claim 7 wherein the electric motor produces an output of generally 15,720 revolutions per minute.

9. The shape former of claim 1, wherein the shape or pattern is formed by one or a combination of cutting, punching or embossing.

10. The shape former of claim 1, wherein the at least one or a combination of articles is selected from paper, plastic, metal and other media.

11. The shape former of claim 9, wherein the shape or pattern is formed with paper by one or more of cutting and punching.

12. A shape forming kit, comprising:

a housing;

a power source;

an electric motor electrically connected to the power source, wherein the electric motor has a forward activation state and a reverse activation state;

at least one plate for supporting one or more dies in a die stack;

a pair of rollers rotatably supported substantially within the housing and operatively connected with the electric motor; wherein the pair of rollers are substantially parallel to each other and are adapted to receive between them a die stack; and wherein the rollers are adapted to exert a compressive force on the die stack as the die stack travels between the rollers, whereby the compressive force of the rollers is sufficient to cause the die stack to do one or more of cut, punch and emboss at least one or a combination of articles of paper, plastic, metal or other media placed within the die stack;

a power source for supplying power to the electric motor, the power source being at least one AA battery; and a first and second activation switch operatively connected to the electric motor for activating the electric motor; wherein the activation switches are located on an outside surface of the housing; and wherein the first activation switch activates the electric motor in the forward activation state and activates four AA batteries for powering the electric motor and the second activation switch activates the electric motor in the reverse activation state and activates six AA batteries for powering the electric motor.

* * * * *